United States Patent [19]

Fillman

[11] Patent Number: 4,653,521

[45] Date of Patent: Mar. 31, 1987

[54] FREEZELESS GROUND HYDRANT AND METHOD FOR OPERATING SAME

[75] Inventor: Russell L. Fillman, Colorado Springs, Colo.

[73] Assignee: Woodford Manufacturing Company, Colorado Springs, Colo.

[21] Appl. No.: 882,728

[22] Filed: Jul. 7, 1986

[51] Int. Cl.[4] ..... E03B 9/04; E03B 9/14

[52] U.S. Cl. ..... 137/1; 137/218; 137/281; 137/301; 137/302; 251/89; 251/111; 251/231; 251/279

[58] Field of Search ..... 137/1, 2, 217, 218, 137/272, 281, 282, 301, 302, 303, 307; 251/89, 94, 111, 231, 242, 279

[56] References Cited

U.S. PATENT DOCUMENTS

| | | | |
|---|---|---|---|
| 609,805 | 8/1898 | Hardy | 137/281 |
| 824,770 | 7/1906 | Williams | 137/301 |
| 2,630,130 | 3/1953 | Murdock et al. | 137/281 |
| 2,648,349 | 8/1953 | McGarry | 137/302 |
| 3,534,762 | 10/1970 | Noland | 137/301 |
| 3,770,000 | 11/1973 | Murdock et al. | 137/281 |
| 3,770,003 | 11/1973 | Uroshevich | 137/281 |
| 4,096,877 | 6/1978 | Arledge, II | 137/301 |
| 4,109,671 | 8/1978 | Hughes et al. | 137/282 |
| 4,282,895 | 8/1981 | Young | 137/301 |
| 4,520,836 | 6/1985 | Hutler, III | 137/301 |

*Primary Examiner*—George L. Walton

*Attorney, Agent, or Firm*—Zarley, McKee, Thomte, Voorhees & Sease

[57] ABSTRACT

The present invention is for a freezeless ground hydrant having a nozzle above ground and having a main valve adapted to be connected to an underground source of water pressure at a point located below the frost line in the soil. Also underground is a drain water storage system including a storage cylinder. When the hydrant is turned off, the residual water in the nozzle drains into the cylinder and is retained there until the hydrant is turned on again. When the hydrant is turned on, a mechanical linkage connected to the hydrant handle causes the cylinder to expel the drain water therein through a drain line which extends upwardly above the ground.

3 Claims, 2 Drawing Figures

FREEZELESS GROUND HYDRANT AND METHOD FOR OPERATING SAME

BACKGROUND OF THE INVENTION

This invention relates to a freezeless hydrant and method for operating same.

Ground hydrants include a nozzle and a handle above ground, and further include a lower end which is positioned below the frost line in the ground where it is connected to a source of water pressure. In order to prevent freezing of the ground hydrant, a drain hole is usually provided at the lower end of the hydrant for permitting the residual water within the hydrant to drain downwardly and outwardly through the hydrant below the frost line. This prevents any water from remaining in the hydrant and freezing during cold weather.

It is desirable to provide a hydrant which permits the drain water to be released above ground rather than below ground so as to avoid the possibility of contamination getting into the drain line due to any malfunction of the device. It is also preferable that the drain water not exit through the nozzle during the next use of the hydrant because the drain water can become contaminated if the hydrant has not been operated for a long period of time.

Therefore, a primary object of the present invention is the provision of an improved ground hydrant and method for operating same.

A further object of the present invention is the provision of an improved ground hydrant having a drain water storage system located below the frost line.

A further object of the present invention is the provision of an improved hydrant wherein the drain water storage system includes a cylinder which forcibly purges the drain water from the system in response to turning the hydrant on with the control handle.

A further object of the present invention is the provision of an improved hydrant which maintains the drain water in an underground reservoir, and which expels the drain water through a drain line which is separate from the outlet nozzle of the hydrant.

A further object of the present invention is the provision of an improved hydrant which minimizes the possibility that water exiting from the hydrant will be contaminated by the drain water stored in an underground storage tank.

A further object of the present invention is the provision of an improved hydrant which expels the drain water above the ground rather than below the ground as in prior hydrants.

A further object of the present invention is the provision of an improved hydrant which is economical to manufacture, durable in use and efficient in operation.

SUMMARY OF THE INVENTION

The present invention utilizes a ground hydrant having an outlet nozzle above the ground and having a line extending therefrom downwardly into the ground below the frost line. The hydrant is connected to a source of water below the ground, and includes a main valve for controlling the flow of the water from the underground source to the nozzle.

Also located below the ground is a drain water storage system which includes a cylinder having a piston reciprocatingly mounted therein. The piston is movable to force water in the cylinder outwardly through a drain opening to a drain line which leads above ground and permits the water to be expelled above ground.

The main valve is movable to a closed position which prevents the flow of water from the water source to the outlet nozzle. When in this closed position, the valve also permits water to drain by gravity from the outlet nozzle downwardly through the valve and into the storage cylinder.

When the handle of the hydrant is moved to its open position, it moves the valve to an open position. In this open position, the valve permits fluid to flow from the water source to the nozzle, but closes off any communication of fluid from the nozzle to the storage cylinder.

A linkage extending between the handle of the hydrant and the piston within the storage cylinder causes the piston to be moved within the cylinder simultaneously with the movement of the valve to its open position. Thus, as the hydrant handle is lifted up to its open position, the valve is moved to its open position and the piston within the cylinder is forced in a direction which will purge the water from the storage hydrant and force the water upwardly and outwardly through the drain above ground.

When the hydrant handle is again moved downwardly to its closed position, the valve moves to its closed position and permits water to drain downwardly through the valve and into the storage cylinder. The linkage between the handle and the piston within the cylinder also causes the piston to be moved upwardly in response to moving of the hydrant handle to its closed position.

A pressure relief valve is provided at the outlet nozzle, and a linkage mechanism is responsive to movement of the handle to its closed position so as to cause the air valve to open, thereby permitting the water within the nozzle to drain downwardly in response to gravity.

DETAILED DESCRIPTION OF THE PREFERRED EMBODIMENT

Figures 1, 2:
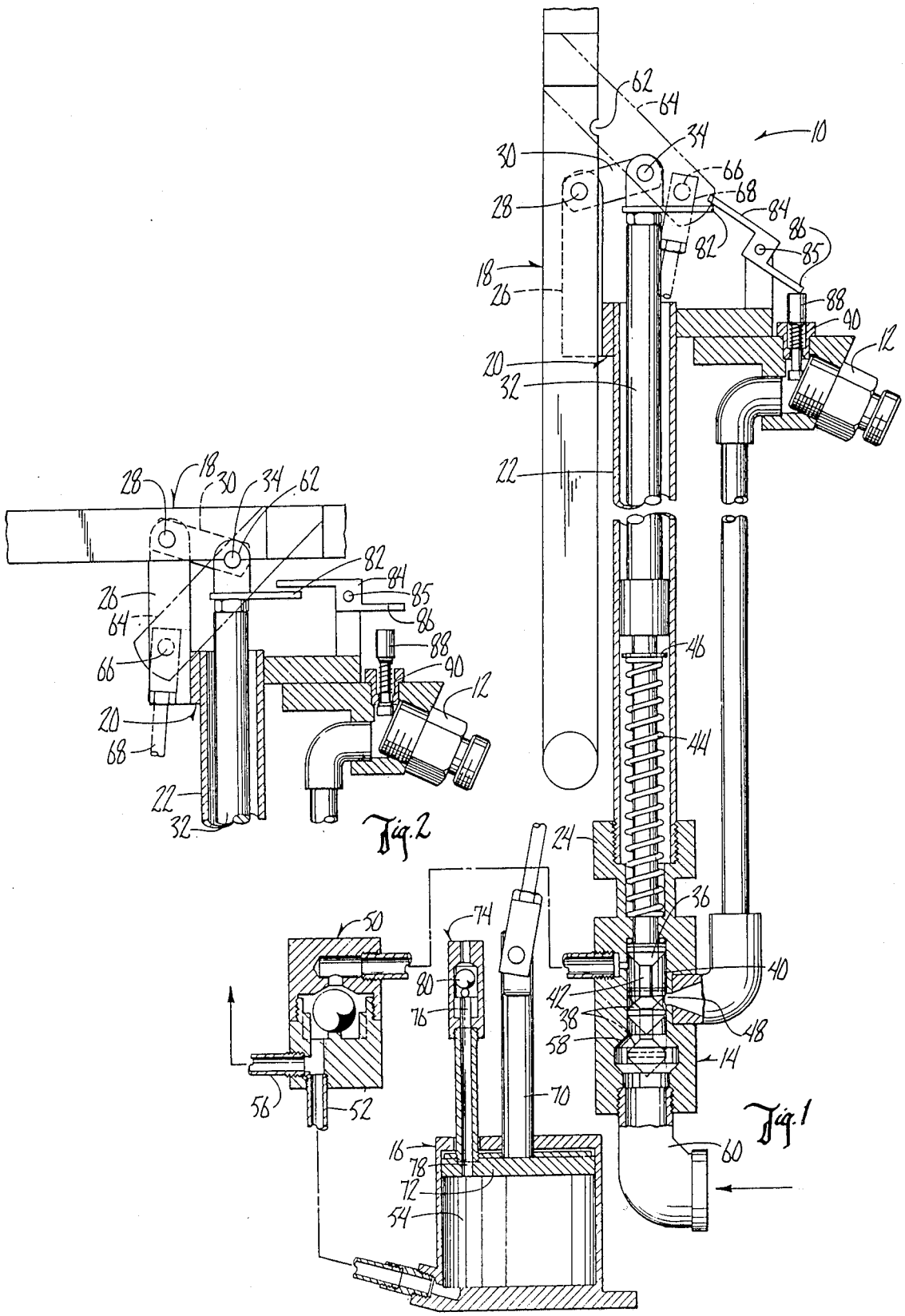
FIG. 1 is an elevational view of the hydrant of the present invention showing portions thereof in section and showing portions thereof in an exploded relationship.
FIG. 2 is a partial sectional view of the nozzle of the hydrant, showing the hydrant handle in the open position.

Referring to the drawings, the numeral 10 generally refers to the freezeless ground hydrant of the present invention. Hydrant 10 includes a nozzle 12, a main valve 14, a drain water storage cylinder 16, and a hydrant handle 18. A hydrant frame 20 includes a vertical casing 22 which is connected at its lower end to main valve 14 by means of a threaded coupling 24. The upper end of frame 20 includes a fixed stub 26 to which handle 18 is pivotally mounted for pivotal movement about an axis 28. An intermediary link 30 is pivotally connected about axis 28 and is also pivotally connected to the upper end of a valve rod 32 by means of a pivot pin 34. Valve rod 32 extends downwardly and is connected to an upper valve member 36 and a lower valve member 38 which are within a valve chamber 40 of main valve 14. A valve stem 42 holds valve members 36, 38 apart from one another. A spring 44 engages the housing of valve 14 and also engages a stop washer 46 on valve rod 32 so as to urge valve rod 32 upwardly to its extreme upper position or drain position shown in solid lines in FIG. 1. In this position, communication from nozzle 12 is provided through a nozzle opening 48 into chamber 40 between valve members 36, 38, and outwardly through a check valve 50 and a line 52 to communication with the interior drain water chamber 54 within drain water cylinder 16. The check valve 50 prevents a back flow of fluid from the drain water cylinder 54 to the main valve chamber 40. Check valve 50 also includes a connection to a drain line 56 which leads to above ground as indicated in FIG. 1.

Valve rod 32 is movable downwardly from its drain position shown in FIG. 1 in solid lines to an operating position shown in phantom lines in FIG. 1. This movement is made against the bias of spring 44. In this operating position, the lower valve member 38 is in an enlarged section 58 within valve 14 so as to permit the introducton of pressurized fluid through coupling 60 upwardly into chamber 40 and through nozzle opening 48 and nozzle 12. When coupling 60 is connected to a source of pressurized water, this permits the water to be forced outwardly through nozzle 12 in normal operating fashion.

The valve rod 32 is moved to this operating position by means of moving handle 18 from the position shown in FIG. 1 to the position shown in FIG. 2. Handle 18 includes an arcuate notch 62 which is adapted to engage pivot pin 34 as shown in FIG. 2 so as to exert a downward force on rod 32 against the bias of spring 44. This causes rod 32 to move downwardly and to move the valve members 36, 38 to their operating position shown in phantom lines in FIG. 1.

Handle member 18 also includes an angled link 64 which is fixed to handle 18 and which is pivoted at 66 to the upper end of a cylinder rod 68 which in turn is connected at its lower end to a piston rod 70. Piston rod 70 is connected to a piston 72 within cylinder 16. An air bleed valve 74 includes a passageway 76 which is in communication through an opening 78 with the drain water chamber 54 below piston 72. A ball check valve 80 is provided within passageway 76 to prevent the upward passing of fluid outwardly through passageway 76. However, when no upward pressure is exerted by fluid against check valve 80, the check valve 80 is open and permits air to enter or leave the interior of cylinder 16.

Connected to the upper end of valve rod 32 is a pawl plate 82 which is adapted to move upwardly and downwardly in unison with rod 32. Pawl plate 82 engages a Z-shaped link 84 which is pivoted to the hydrant frame about axis 85. Pawl link 84 includes a finger 86 which is adapted to engage a push button valve 88. Push button valve 88 is normally spring biased upwardly into a seated position by a spring 90, but when engaged by finger 86 and pressed downwardly, push button valve 88 will open to provide air communication into the interior of nozzle 12.

In operation, handle 18 is normally in the off position shown in FIG. 1. In this position, valve members 36, 38 are in their closed position shown in solid lines in FIG. 1. Also, the actuation rod 68 maintains the piston 72 in an elevated position such as shown in FIG. 1, and the Z-shaped link 84 is in the position shown in FIG. 1 with finger 86 depressing pushbutton valve 88 to provide air communication into nozzle 12. This permits any residual water in nozzle 12 to drain downwardly and pass through valve 14 and check valve 50 into drain water chamber 54.

When it is desired to turn the hydrant on, handle 18 is elevated to the position shown in FIG. 2. In this position, the Z-shaped member is permitted to move to its horizontal position shown in FIG. 2 so that pushbutton valve 88 is biased upwardly to its closed position by virtue of spring 90. At the same time, rod 68 is forced downwardly so as to depress piston 72 and force fluid within drain water chamber 54 outwardly through line 52 and drain line 56 where it is expelled from drain line 56 above the ground. Any back pressure exerted by the fluid within drain chamber 54 upwardly through passageway 76 is blocked by virtue of check valve ball 80.

Simultaneously with the raising of handle 18 to its upper position, notch 62 comes into engagement with pin 34 and depresses valve rod 32 so that the valve members 36, 38 move downwardly to their open position shown in shadow lines shown in FIG. 1. In this position, the water source is connected directly to nozzle 12 and forces water outwardly through nozzle 12.

When the handle is again depressed to its closed position shown in FIG. 1, the valve members 36, 38 are again moved to their drain position so that the residual water within nozzle 12 can drain downwardly through nozzle opening 48, valve chamber 40, check valve 50 and line 52 into chamber 54. At the same time, residual water within the drain line 56 is also permitted to drain downwardly by gravity into chamber 54. The movement of handle 18 from its open position of FIG. 2 to its closed position of FIG. 1 causes the piston 72 to be raised so as to provide space in chamber 54. The raising of piston 52 requires the entry of air into chamber 54 so as to relieve a vacuum in chamber 54. This is accomplished by means of the channel 76 and opening 78 which permit air to enter channel 54.

The device keeps the drain water of cylinder 16 separate from the nozzle 12 so that none of the drain water that is being stored below ground ever re-enters the nozzle 12 after it has drained into chamber 54. Instead, it is automatically expelled through drain line 56 each time the handle is raised to its open position.

Thus it can be seen that the device accomplishes at least all of its stated objectives.

What is claimed is:

1. A ground hydrant comprising:

an outlet nozzle;

a drain water system comprising a cylinder having a piston therein and having a drain water chamber on one side of said piston, a drain opening being in said cylinder for permitting water to enter and exit said drain water chamber, a drain line being connected to said drain opening, said piston being movable from a drain position to a purge position for causing water to be forced out of said drain water chamber through said drain opening and said drain line, and being movable from said purge position to said drain position to permit water to drain into said drain water opening;

main valve means adapted for fluid connection to a source of water pressure, and also being fluidly connected to said outlet nozzle, and said drain opening of said cylinder, said main valve means being movable to an off position wherein main valve means is disconnected from said water source and said outlet nozzle is closed off from said water source and connected to said drain opening of said cylinder for permitting water to drain from said nozzle to said cylinder, said main valve means also being movable to an on position wherein said outlet nozzle, and said water source are in communication with one another and are closed off from said drain opening of said cylinder;

manually operable mechanism connected to said main valve means and said piston for selectively moving said main valve means to said on and off positions, and for selectively moving said piston between said drain and purge positions.

2. A ground hydrant according to claim 1 comprising check valve means between said drain opening of said cylinder and said main valve means for preventing back flow of water from said cylinder into said main valve means.

3. A method for automatically draining a ground hydrant having a nozzle above the ground and a cylinder located below the ground, said cylinder having a piston and a drain water chamber on one side ot said piston, said cylinder having a drain opening providing communication into said drain water chamber; a drain line being connected to said drain opening and extending upwardly to a drain outlet above ground, said method comprising:

connecting said nozzle to a pressurized water source whereby pressurized water will be forced outwardly from said nozzle;

providing value means for shutting off said nozzle from said water source and connecting said nozzle to said drain opening of said drain water chamber;

providing fluid communication between said nozzle and said drain water chamber whereby the residual water within said nozzle and said drain line will drain by gravity into said water chamber;

providing check valve means between said drain opening and said valve means for preventing back flow of water from said drain opening of said cylinder toward said nozzle;

purging said drained residual water from said drain water chamber by moving said piston toward said drain water chamber to force water outwardly onto the ground through said drain opening, said drain line, and said drain outlet and by simultaneously moving said valve means from an open position to a closed position.

* * * * *